US009436145B2

(12) United States Patent
Shirafuji

(10) Patent No.: US 9,436,145 B2
(45) Date of Patent: Sep. 6, 2016

(54) IMAGE FORMING APPARATUS INCLUDING CORRECTION UNIT THAT CORRECTS TONE CORRECTION TABLE

(71) Applicant: CANON KABUSHIKI KAISHA, Tokyo (JP)

(72) Inventor: Yasuhito Shirafuji, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/563,999

(22) Filed: Dec. 8, 2014

(65) Prior Publication Data

US 2015/0168903 A1 Jun. 18, 2015

(30) Foreign Application Priority Data

Dec. 18, 2013 (JP) ..... 2013-261839

(51) Int. Cl.
*G03G 15/00* (2006.01)

(52) U.S. Cl.
CPC .. *G03G 15/5041* (2013.01); *G03G 2215/0129* (2013.01); *G03G 2215/0164* (2013.01)

(58) Field of Classification Search
CPC ..... G03G 15/55; G03G 15/556
See application file for complete search history.

(56) References Cited

U.S. PATENT DOCUMENTS

| | | | |
|---|---|---|---|
| 5,583,644 | A | 12/1996 | Sasanuma et al. |
| 5,752,126 | A | 5/1998 | Muramatsu |

FOREIGN PATENT DOCUMENTS

| | | | |
|---|---|---|---|
| JP | 04-267272 | A | 9/1992 |
| JP | 06-198973 | A | 7/1994 |
| JP | 2000-089531 | A | 3/2000 |
| JP | 2005-210469 | A | 8/2005 |

*Primary Examiner* — Erika J Villaluna
(74) *Attorney, Agent, or Firm* — Fitzpatrick, Cella, Harper & Scinto

(57) ABSTRACT

An image forming apparatus includes: a forming unit configured to form an image on an image carrier; a holding unit configured to hold a reference table and a tone correction table that convert a plurality of input image data values into corresponding output image data values; and a correcting unit configured to control the forming unit to form a first test pattern including a plurality of images having different densities on the image carrier using the tone correction table, and correct the tone correction table by detecting densities of the plurality of images. The correcting unit is further configured to correct the tone correction table by updating the tone correction table using the detected densities of the plurality of images and then interpolating the updated tone correction table using the reference table.

9 Claims, 8 Drawing Sheets

FIG. 10A

| |
|---|
| 15 |
| 45 |
| 105 |
| 165 |
| 225 |

FIG. 10B

| |
|---|
| 30 |
| 75 |
| 135 |
| 195 |
| 255 |

IMAGE FORMING APPARATUS INCLUDING CORRECTION UNIT THAT CORRECTS TONE CORRECTION TABLE

BACKGROUND OF THE INVENTION

1. Field of the Invention

The present disclosure relates to density control techniques in image forming apparatuses.

2. Description of the Related Art

Image forming apparatuses that use electrophotographic systems require stable densities and tones in output images. To that end, U.S. Pat. No. 5,752,126 and U.S. Pat. No. 5,583,644 disclose configurations that stabilize the quality of an image by forming a test pattern on an image carrier and adjust image forming conditions, generate a tone correction table, and so on by reading the density of the formed test pattern using a sensor.

When creating a tone correction table, correction values for densities not formed by the test pattern are obtained by interpolating results of measuring the densities formed by the test pattern. However, pixel values in the image data provided to the image forming apparatus and the densities actually formed by those pixel values are not in a linear relationship, and error appears particularly in low-density and high-density regions where the degree of non-linearity is more marked. Although increasing the number of densities formed by the test pattern is conceivable as a way to solve this problem, doing so increases the time required for tone control and drastically reduces productivity.

SUMMARY OF THE INVENTION

According to an aspect of the present invention, an image forming apparatus includes: a forming unit configured to form an image on an image carrier; a holding unit configured to hold a reference table and a tone correction table that convert a plurality of input image data values into corresponding output image data values; and a correcting unit configured to control the forming unit to form a first test pattern including a plurality of images having different densities on the image carrier using the tone correction table, and correct the tone correction table by detecting densities of the plurality of images. The correcting unit is further configured to correct the tone correction table by updating the tone correction table using the detected densities of the plurality of images and then interpolating the updated tone correction table using the reference table.

Further features of the present invention will become apparent from the following description of exemplary embodiments with reference to the attached drawings.

BRIEF DESCRIPTION OF THE DRAWINGS

FIGS. 10A and 10B are diagrams illustrating combinations of image data used in test patterns according to an embodiment.

DESCRIPTION OF THE EMBODIMENTS

Hereinafter, exemplary embodiments of the present invention will be described with reference to the drawings. Note that the following embodiments are to be taken as examples only, and the scope of the present invention is not intended to be limited to the embodiments. Note also that constituent elements not necessary for the descriptions of the embodiments have been omitted from the drawings.

First Embodiment

Figure 1:
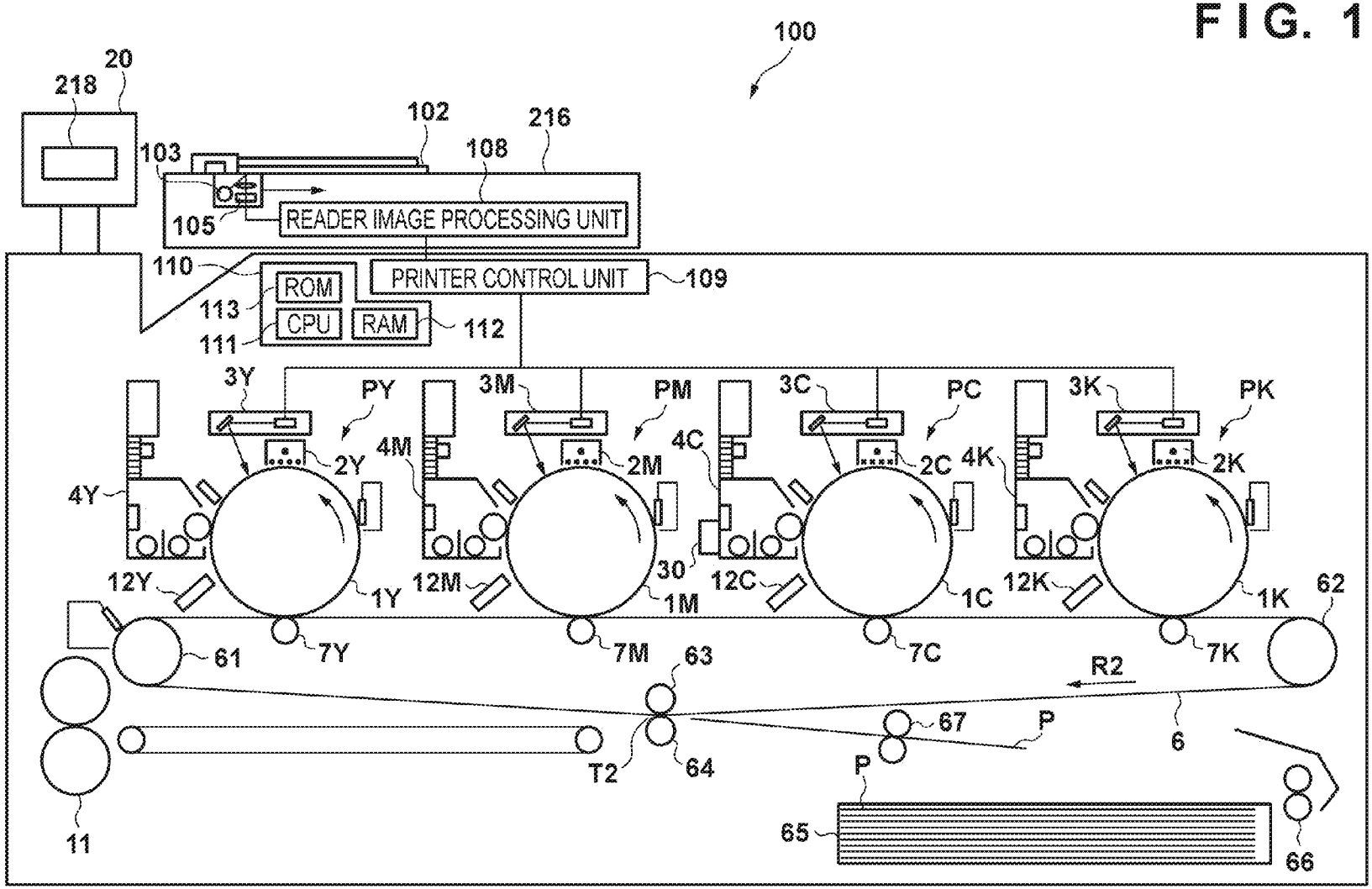
FIG. 1 is a schematic diagram illustrating an image forming apparatus according to an embodiment.

FIG. 1 is a schematic diagram illustrating an image forming apparatus 100 according to the present embodiment. In the image forming apparatus 100 shown in FIG. 1, yellow, magenta, cyan, and black image forming sections PY, PM, PC, and PK are arranged along an intermediate transfer belt 6. A photosensitive member 1Y of the image forming section PY, which serves as an image carrier, is rotationally driven in the direction of the arrow shown in FIG. 1, and is charged to a predetermined potential by a charging unit 2Y. An exposure unit 3Y forms an electrostatic latent image on the surface of the photosensitive member 1Y by scanning and exposing the photosensitive member 1Y with light. A developing unit 4Y visualizes the electrostatic latent image on the photosensitive member 1Y as a toner image by outputting a developing bias and supplying yellow toner (coloring material) to the electrostatic latent image. A primary transfer roller 7Y outputs a primary transfer bias and transfers the toner image formed on the photosensitive member 1Y to the intermediate transfer belt 6 serving as an image carrier. The image forming section PY also includes a density sensor 12Y for detecting the density of the toner image formed on the photosensitive member 1Y. The density sensor 12Y emits light onto the photosensitive member 1Y and detects the density based on light reflected thereby, for example.

Aside from the color of the toner used, the image forming sections PM, PC, and PK have the same configuration as the image forming section PY, and thus descriptions of the image forming sections PM, PC, and PK will be omitted here. Note also that in the following descriptions, reference numerals without the letters Y, M, C, and K appended thereto will be used in cases where it is not necessary to distinguish between different colors. A multicolor toner image is formed on the intermediate transfer belt 6 by transferring the toner images formed on the photosensitive members 1 of the respective image forming sections onto the intermediate transfer belt 6 in a superimposed manner.

The intermediate transfer belt 6 is wrapped upon three rollers 61, 62, and 63, and is rotationally driven in the direction of R2 indicated in FIG. 1. A recording material P, which is an image carrier extracted from a cassette 65, is conveyed, by roller pairs 66 and 67, toward a secondary transfer portion T2 configured of the roller 63 and a secondary transfer roller 64. The toner image transferred onto the intermediate transfer belt 6 is then transferred onto the recording material P at the secondary transfer portion T2. The recording material P is then heated and compressed by a fixing unit 11, the toner image is fixed, and the recording material P is discharged to the exterior of the apparatus.

A light source 103 of a reading unit 216 emits light onto a recording material placed on a platen 102, and a CCD sensor 105 reads an image of the recording material by receiving the light reflected therefrom. Image data read by the CCD sensor 105 undergoes predetermined image processing in a reader image processing unit 108 and a printer control unit 109. Note that the image forming apparatus 100 according to the present embodiment is configured to be capable of printing image data received over a telephone line (fax), image data received from a computer over a network, and so on, in addition to images read by the reading unit 216. Meanwhile, an operating unit 20 enables a user to operate the image forming apparatus 100, and includes a display unit 218 for displaying the status of the image forming apparatus 100 to the user. A control unit 110 performs overall control of image forming operations carried out by the image forming apparatus 100, and includes a CPU 111, a RAM 112, and a ROM 113. The control unit 110 determines and obtains density information of the toner image formed on the photosensitive member 1 based on a signal from the density sensor 12. The CPU 111 controls the image forming apparatus 100 using programs and various types of data held in the ROM 113, employing the RAM 112 as a work area. Furthermore, the image forming apparatus 100 includes an environment sensor 30 that obtains information of the environment in which the image forming apparatus is located, such as temperature, humidity, or both, and communicates this information to the control unit 110.

Figure 2A:
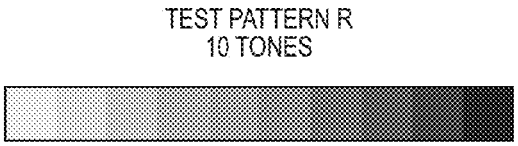
FIGS. 2A and 2B are diagrams illustrating a test pattern according to an embodiment.

Next, tone correction control according to the present embodiment will be described. Note that the tone correction control is carried out for each color. In the present embodiment, the tone correction control is performed in response to a user operation or to a predetermined condition being met. In the tone correction control, the toner image formed on and fixed onto the recording material, the fixed toner image is read by the reading unit 216, and image forming conditions related to density are determined. In this density control, an image forming condition value for forming an image at a maximum density serving as a target (referred to as a "target maximum density" hereinafter; the condition value will be referred to as a "maximum density condition value"), and a tone correction table for converting the values of input image data in order to realize the target density, are created. Using the created tone correction table, a test pattern R is furthermore formed on the photosensitive member 1 using the maximum density condition value that has been determined. In the present embodiment, the test pattern R is a pattern including images of ten types of different densities (tones), including a solid-color area (maximum density area), as shown in FIG. 2A. The image forming apparatus 100 measures the densities in the test pattern R using the density sensor 12 and obtains target density information expressing a relationship between the input values of the image data used to form the test pattern R and the densities formed on the photosensitive member 1 using those input values.

Figure 2B:
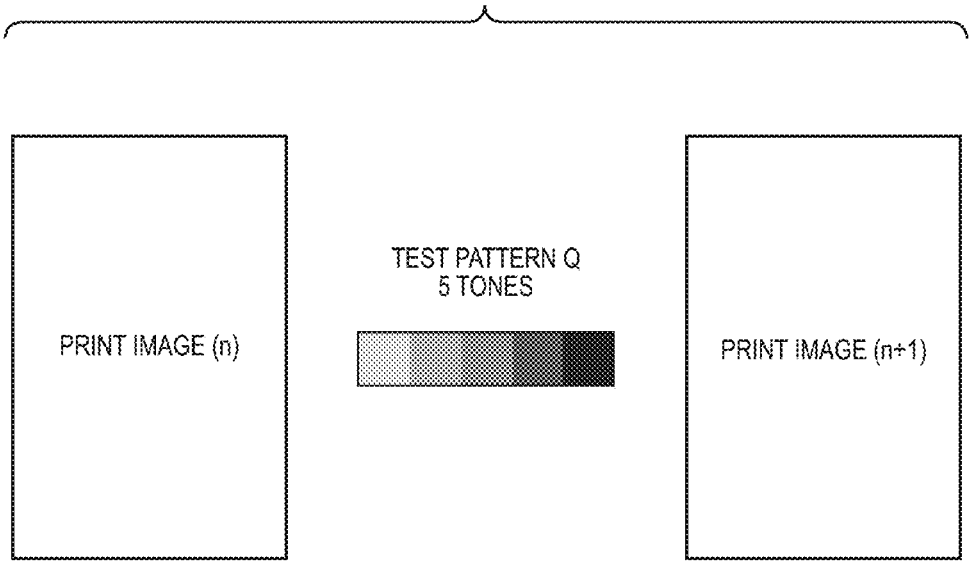

Then, when sequentially forming images, the image forming apparatus 100 executes correction control using the tone correction table (called simply "correction control" hereinafter) each time a predetermined number of sheets passes through. In the correction control, a test pattern Q, which has a lower number of densities than the test pattern R formed in the tone correction control, is formed on the photosensitive member 1, as shown in FIG. 2B; the densities in the test pattern Q are then detected by the density sensor 12. In the present embodiment, the test pattern Q is a pattern including images of five types of different densities (tones), including a solid-color area (maximum density area). Note that in the correction control, the test pattern Q is formed in a region on the photosensitive member 1 between toner images to be printed, as shown in FIG. 2B.

Figure 3:
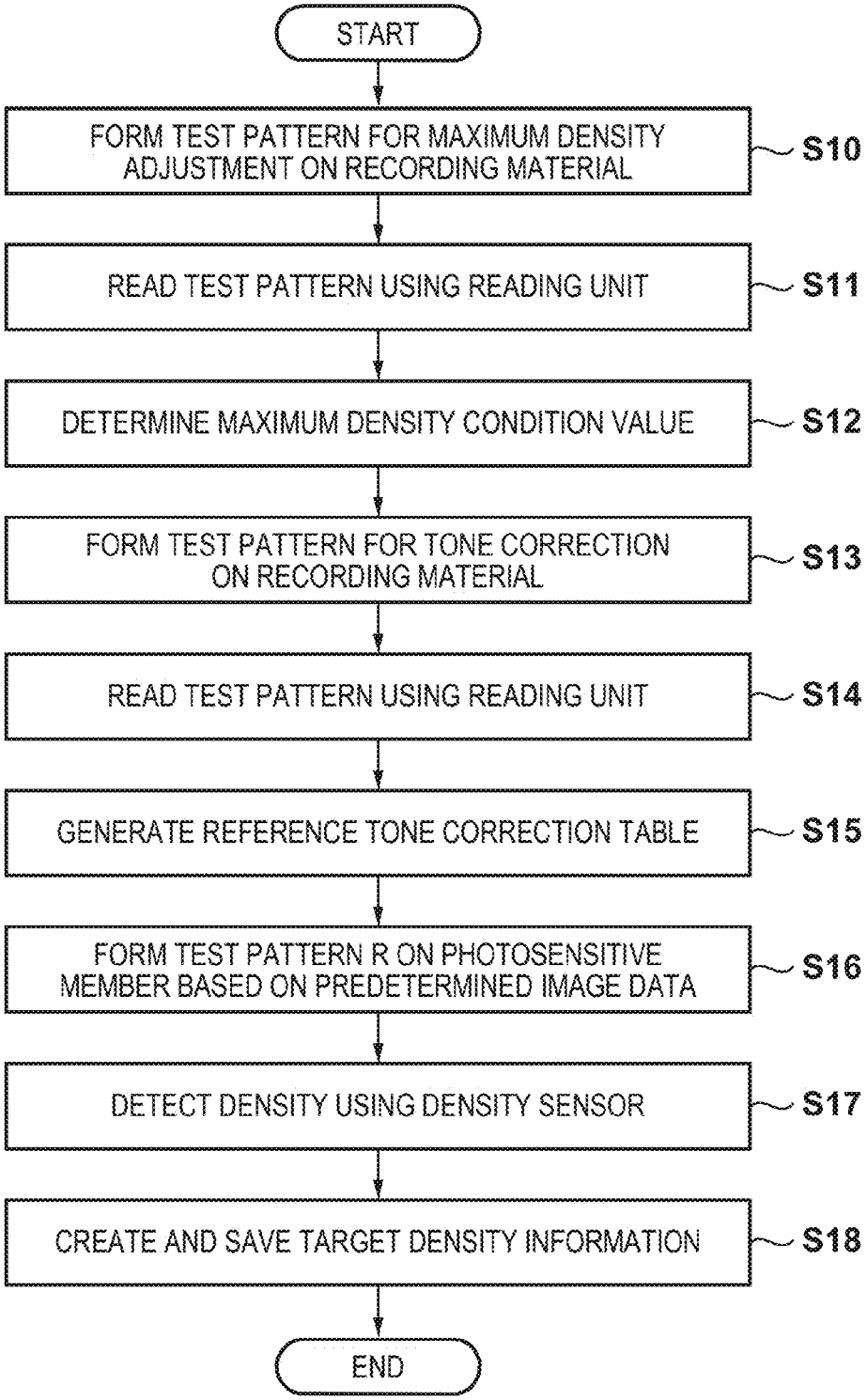
FIG. 3 is a flowchart illustrating tone correction control according to an embodiment.
Figure 4A:
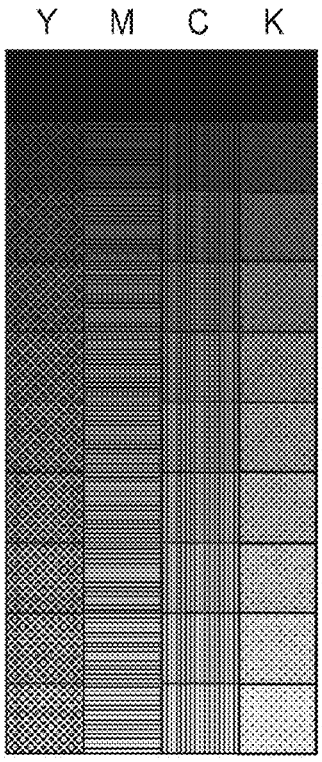
FIGS. 4A and 4B are diagrams illustrating a toner image formed in tone correction control according to an embodiment.

First, details of the tone correction control will be described using FIG. 3. In S10, the control unit 110 forms a test pattern on the recording material using image data of a value expressing a maximum density. FIG. 4A illustrates an example of the test pattern formed in S10. In the case where the image data is 8-bit data, for example, the test pattern shown in FIG. 4A takes a value of 255, which expresses the maximum density, as the stated maximum density value, and is formed while varying an image forming condition regarding the density. Although the following descriptions assume that an exposure amount is used as the image forming condition varied for the density control, the configuration may be such that other image forming conditions regarding the density are used, such as other values that vary the developing contrast, namely the developing bias, a charging bias, and the like. A configuration that varies multiple image forming conditions related to density may also be employed. A user sets the recording material on which the test pattern has been formed in the reading unit 216, and in S11, the control unit 110 detects the densities in the test pattern by causing the reading unit 216 to read the test pattern. In S12, based on the detected densities, the control unit 110 determines the maximum density condition value, or in other words, a value of the image forming condition at which the toner image formed using the image data expressing the maximum density as input values reaches the target maximum density. Note that the image forming condition is the exposure amount in this example, as described above.

Figure 4B:
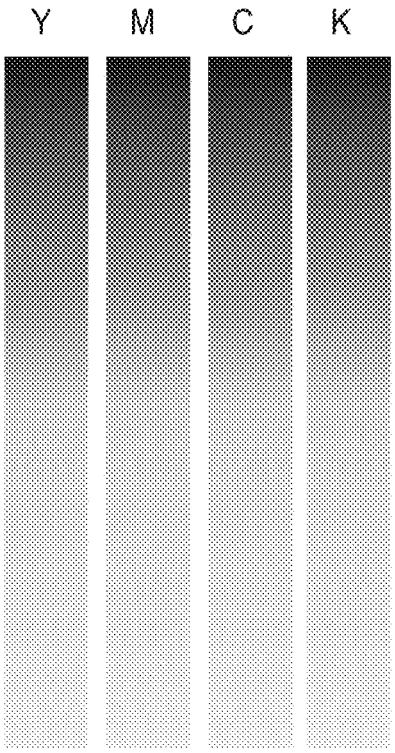

Next, in S13, the control unit 110 forms a test pattern for tone correction on the recording material. FIG. 4B illustrates an example of the test pattern formed in S13. In the case where the image data is 8-bit data, for example, the test pattern shown in FIG. 4B is formed using multiple values selected from 0 to 255, such as 64 values. The user sets the recording material on which the test pattern has been formed in the reading unit 216, and in S14, the control unit 110 detects the densities of the test pattern by causing the reading unit 216 to read the test pattern. In S15, the control unit 110 generates a reference tone correction table (reference table) based on the detected densities and saves the generated table in the RAM 112. Then, in S16, the control unit 110 forms the test pattern R shown in FIG. 2B on the photosensitive member 1 using the reference tone correction table, and uses the density sensor 12 to detect the densities thereof in S17. The control unit 110 then generates the target density information, which expresses a relationship between the image data values used in S16 and the densities in the test pattern detected in S17, and saves the generated information in the RAM 112 in S18. A solid line in FIG. 5 indicates the target density information saved in S18.

Next, correction control according to the present embodiment will be described using FIG. 6. Note that the first time the correction control is carried out after the tone correction control has been performed, the tone correction table to be corrected is the reference tone correction table, whereas in subsequent instances of the correction control, the tone correction table corrected through the previous correction control is the subject of the correction. However, the control unit 110 continues to hold the reference tone correction table in the RAM 112 even after the correction control has been performed. In other words, two tables, namely the reference tone correction table and the tone correction table corrected through the correction control, are held in the RAM 112 after the correction control has been executed. After the tone correction control has been executed, the control unit 110 forms images using the reference tone correction table until the correction control is carried out for the first time, and then forms images using the corrected tone correction table after the correction control has been executed.

Figure 5:
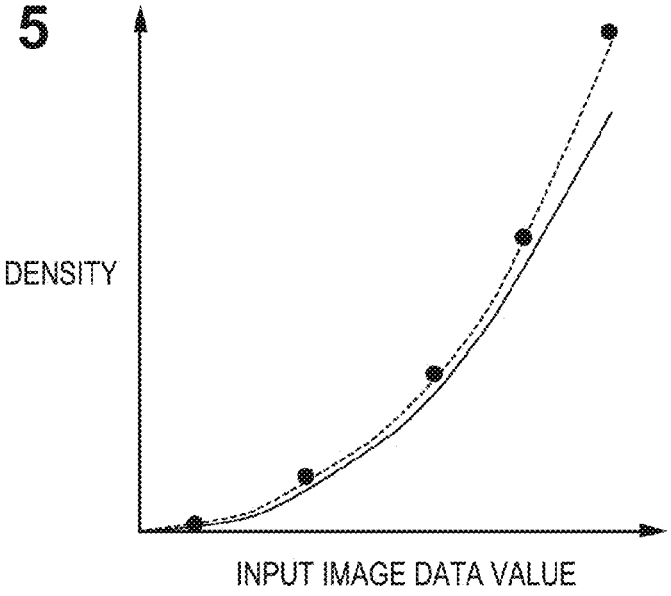
FIG. 5 is a diagram illustrating a target density and the density of a test pattern detected in correction control according to an embodiment.
Figure 7:
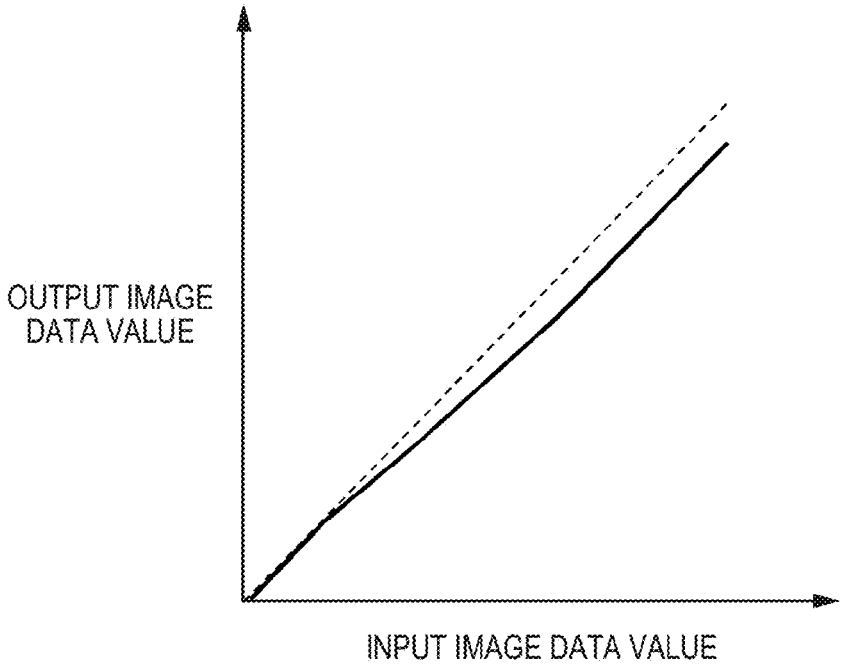
FIG. 7 is a diagram illustrating a graph corresponding to an inverse transform table according to an embodiment.

Note that the correction control is performed each time a predetermined number of sheets passes through when sequentially forming images, as mentioned above. When the correction control starts, in S20, the control unit 110 forms the test pattern Q shown in FIG. 2B on the photosensitive member 1. Note that the number of images of different densities contained in the test pattern Q, which in this example is five, is less than the number of images of different densities contained in the test pattern shown in FIG. 4B and used to generate the reference tone correction table, the test pattern shown in FIG. 2A formed in order to obtain the target density information, and so on. In S21, the control unit 110 detects the densities in the test pattern Q using the density sensor 12, and linearly interpolates the detection results in S22. The black circles in FIG. 5 are obtained by plotting the image data values of the five densities in the test pattern Q against the respective detected densities, and the dotted line curve indicates the result of the linear interpolation. Next, in S23, the control unit 110 creates an inverse transform table by carrying out an inverse transform on the detection result indicated by the dotted line using the target density information, indicated by a solid line. FIG. 7 illustrates input image data values and output image data values indicated in the inverse transform table as a graph. The dotted line in FIG. 7 indicates the inverse transform table in the case where the detection results obtained in S22 match the target density information, with the input image data values and output image data values having the same corresponding values. On the other hand, the solid line in FIG. 7 indicates an example of the inverse transform table in the case where the detection results obtained in S22 are denser than the target density expressed by the target density information, as shown in FIG. 5. The input image data values have been converted to lower values in the solid line in FIG. 7 in order to bring the obtained density closer to the target density.

Figure 8:
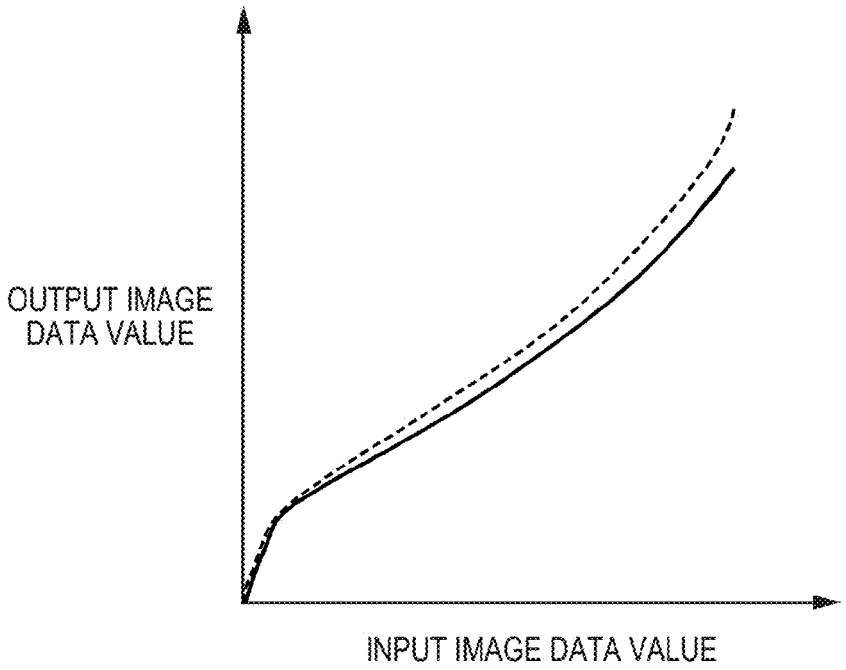
FIG. 8 is a diagram illustrating a tone correction table according to an embodiment.

In S24, the control unit 110 updates the tone correction table using the tone correction table to be corrected, held in the RAM 112, and the inverse transform table created in S23. As described above, the tone correction table to be corrected is the reference tone correction table generated through the tone correction control in the case where the correction control has not been performed even once, and is the tone correction table corrected in the previous correction control in the case where the correction control has been performed once or more. The dotted line in FIG. 8 is a graph of the pre-update tone correction table, and the solid line in FIG. 8 is a graph of the updated tone correction table in the case where the inverse transform table is as indicated by the solid line in FIG. 7. The updated tone correction table is obtained, for example, by dividing an output image data value in the inverse transform table shown in FIG. 7 by the corresponding input image data value, and multiplying the corresponding value in the pre-update tone correction table by the value obtained through the stated division. For example, subsequent image forming can also be carried out using the tone correction table updated in S24. However, in the present embodiment, the test pattern Q formed in S20 has a lower number of tones than the test pattern, shown in FIG. 4A, that is used to generate the reference tone correction table. As such, an interpolation process is carried out for the updated tone correction table in S25. This is done because the values found through the linear interpolation carried out in S22 are skewed from the actual characteristics. The interpolation process carried out in S25 will be described in detail below.

First, the following descriptions assume that the image data is 8-bit data for each pixel, or in other words, that each pixel takes on a value from 0 to 255. $Y_i$ (where i is an integer from 0 to 255) is taken as an output image data value that corresponds to the input image data value i in the tone correction table updated in S24. Furthermore, $YR_i$ is taken as an output image data value that corresponds to the input image data value i in the reference tone correction table. Further still, the five input values for the image data used to form the test pattern Q are represented by p1, p2, p3, p4, and p5. Note that $p1<p2<p3<p4<p5$.

The control unit 110 finds the output image data values in the interpolated tone correction table corresponding to the input image data values i through the following formulae.

when $0 \le i \le p1$ $$(Y_{p1}-0)/(YR_{p1}-0)\times(YR_i-0)+0$$

when $p1 \le i \le p2$ $$(Y_{p2}-Y_{p1})/(YR_{p2}-YR_{p1})\times(YR_i-YR_{p1})+Y_{p1}$$

when $p2 \le i \le p3$ $$(Y_{p3}-Y_{p2})/(YR_{p3}-YR_{p2})\times(YR_i-YR_{p2})+Y_{p2}$$

when $p3 \le i \le p4$ $$(Y_{p4}-Y_{p3})/(YR_{p4}-YR_{p3})\times(YR_i-YR_{p3})+Y_{p3}$$

when $p4 \le i \le p5$ $$(Y_{p5}-Y_{p4})/(YR_{p5}-YR_{p4})\times(YR_i-YR_{p4})+Y_{p4}$$

In the corrected tone correction table found through the aforementioned formulae, the output image data values corresponding to the input values used to form the test pattern Q are the same as the output image data values in the tone correction table updated using the results of detecting the test pattern Q. The output image data value corresponding to an input value between two adjacent input values among the input values used to form the test pattern Q is interpolated according to the reference tone correction table.

The control unit 110 saves the tone correction table created through the interpolation process performed in S25 in the RAM 112, and uses that table in subsequent image forming processes. Note that the values used in the updated tone correction table in the aforementioned formulae are $Y_{pi}$ only. Accordingly, the configuration may be such that the linear interpolation process of S22 is not provided, and the output image data values of the tone correction table to be corrected that correspond to the input values used to form the test pattern Q are updated using the results of detecting the test pattern Q, and are then interpolated using the reference tone correction table. Regardless of what configuration is employed, the graph of the output image data values corresponding to the input image data values p(k−1) to pk (where k is 1 to 5) in the interpolated tone correction table is based on the form of the reference tone correction table, and thus the values thereof are based on the values of the tone correction table updated based on the detection results.

Figure 6:
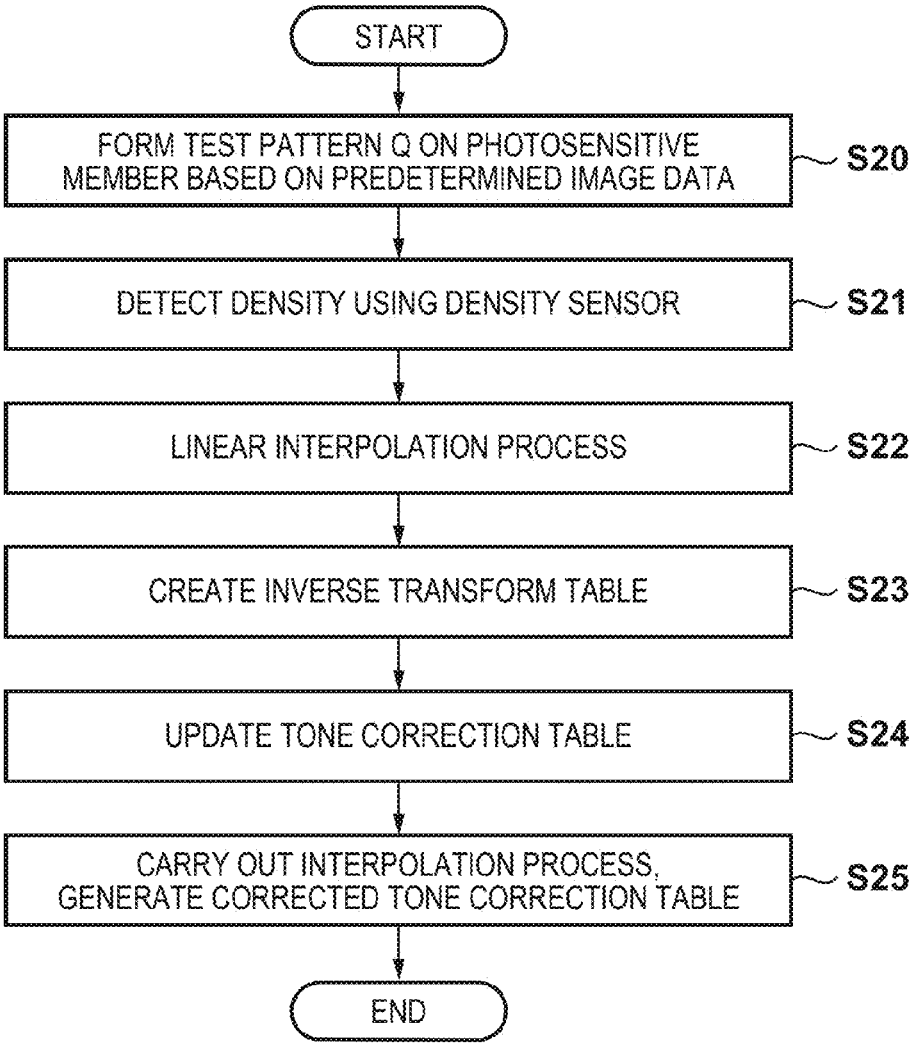
FIG. 6 is a flowchart illustrating correction control according to an embodiment.
Figure 9A:
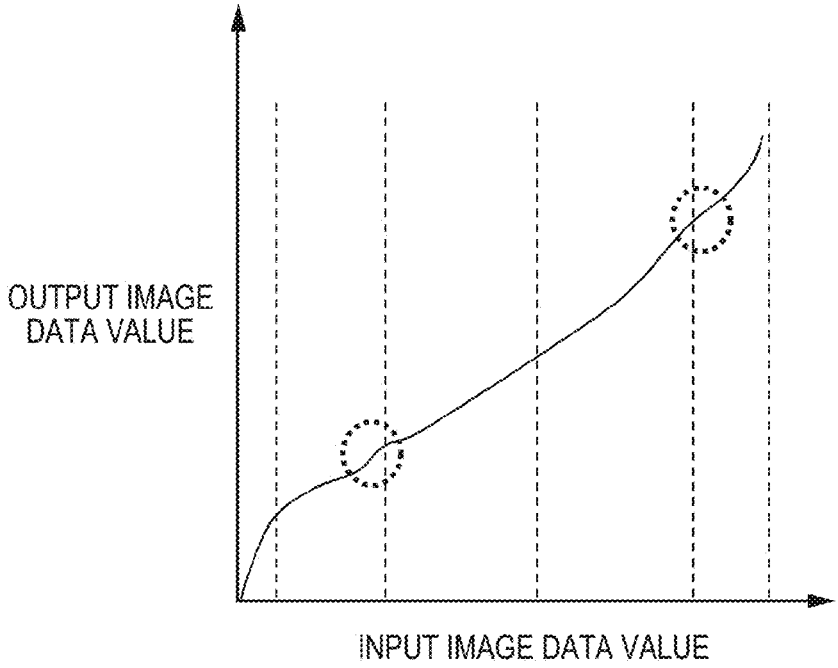
FIGS. 9A and 9B are diagrams illustrating a tone correction table and a post-interpolation tone correction table according to an embodiment.
Figure 9B:
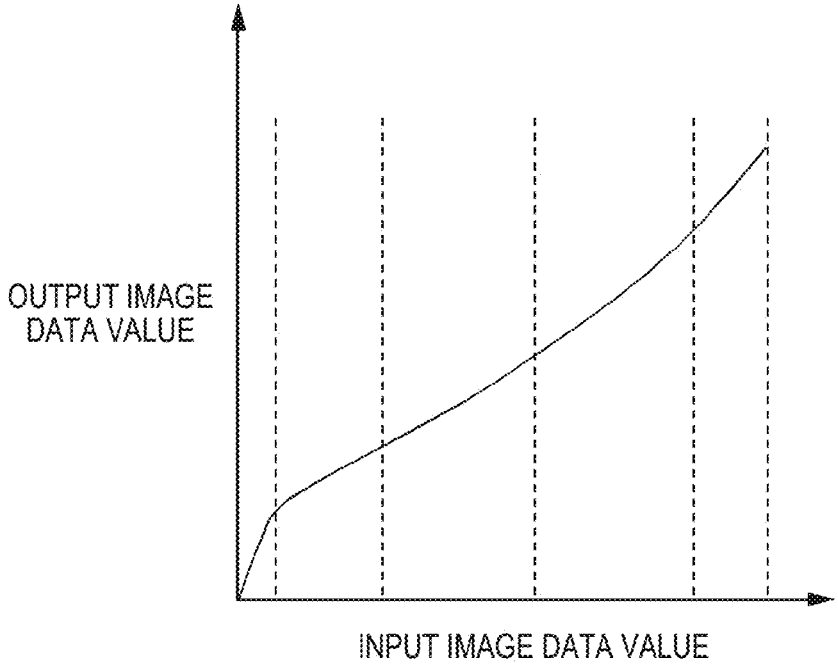

FIG. 9A is a graph expressing the tone correction table updated in S24 of FIG. 6 after 10,000 sheets of paper have passed through in succession, and FIG. 9B is a graph illustrating a tone correction table interpolated in S25 of FIG. 6. Compared to FIG. 9B, there is an area in FIG. 9A where the slope of the graph changes drastically (the area enclosed by the dotted line). Furthermore, tone collapse, pseudo-borders, and so on appear in images formed using the tone correction table shown in FIG. 9A. On the other hand, such tone collapse, pseudo-borders, and so on do not appear in images formed using the interpolated tone correction table shown in FIG. 9B. Accordingly, using the reference tone correction table to carry out an interpolation process on the tone correction table created using a test pattern with few densities makes it possible to carry out tone correction control accurately.

Although the reference tone correction table is formed by reading a test pattern fixed onto a recording material in the present embodiment, the table may instead be formed by using a sensor to detect the test pattern formed on the intermediate transfer belt 6, the photosensitive member 1, or the like, for example. Regardless of which configuration is used, interpolation is carried out in the correction control using the reference tone correction table in the present embodiment, which makes it possible to accurately correct the tone correction table using a test pattern with a low number of images.

Second Embodiment

In the first embodiment, the densities used in the test pattern Q are fixed, but in the present embodiment, the densities are varied with each instance of correction control. For example, FIG. 10A illustrates a first combination of five densities used in the test pattern Q, whereas FIG. 10B illustrates a second combination. These two combinations are used in an alternating manner each time the correction control is performed, for example. As a result, a greater number of types of densities are formed than in the first embodiment, which in turn makes it possible to increase the accuracy of control. Note that rather than two combinations as shown in FIGS. 10A and 10B, the configuration may be such that any desired number of three or more combinations may be switched in order and used.

Third Embodiment

In the first embodiment, the respective detected densities in the test pattern Q measured in S22 of FIG. 6 are linearly interpolated. In the present embodiment, a reference correction table is used in the interpolation of the respective detected densities in the test pattern Q in S22 of FIG. 6. The interpolation process using the reference tone correction table carried out in S22 uses the same calculation formulae, aside from $Y_i$ in the first embodiment being replaced with the image data values corresponding to the detected densities of FIG. 5.

Other Embodiments

Embodiments of the present invention can also be realized by a computer of a system or apparatus that reads out and executes computer executable instructions (e. g., one or more programs) recorded on a storage medium (which may also be referred to more fully as a 'non-transitory computer-readable storage medium') to perform the functions of one or more of the above-described embodiments and/or that includes one or more circuits (e. g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e. g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-261839, filed on Dec. 18, 2013, which is hereby incorporated by reference herein in its entirety.

What is claimed is:

1. An image forming apparatus comprising:

a forming unit configured to form an image on an image carrier;

a holding unit configured to hold a reference table and a tone correction table that convert a plurality of input image data values into corresponding output image data values; and a correcting unit configured to control the forming unit to form a first test pattern including a plurality of images having different densities on the image carrier using the tone correction table, and correct the tone correction table by detecting densities of the plurality of images, wherein the correcting unit is further configured to correct the tone correction table by updating the tone correction table using the detected densities of the plurality of images and then interpolating the updated tone correction table using the reference table, wherein the reference table is generated using a second test pattern including a plurality of images having different densities, and a number of the images having different densities included in the second test pattern is greater than a number of the images having different densities included in the first test pattern.

2. The image forming apparatus according to claim 1, wherein the correcting unit is further configured to update the tone correction table by comparing the detected densities of the plurality of images with target densities for the input image data values used to form the plurality of images.

3. The image forming apparatus according to claim 2, wherein the target densities are obtained when generating the reference table, by detecting densities of a plurality of images formed on the image carrier as a result of converting a plurality of different input image data values using the generated reference table.

4. The image forming apparatus according to claim 1, wherein the correcting unit is further configured to update the tone correction table by linearly interpolating the detected densities of the plurality of images and then comparing the densities of input image data values obtained through the interpolation with target densities for the input image data values.

5. The image forming apparatus according to claim 1, wherein the correcting unit is further configured to update the tone correction table by interpolating the detected densities of the plurality of images using the reference table and then comparing the densities of input image data values obtained through the interpolation with target densities for the input image data values.

6. The image forming apparatus according to claim 1, wherein the correcting unit includes a plurality of combinations of the plurality of images having different densities formed as the first test pattern, and is further configured to form the first test pattern by selecting a single combination from the plurality of combinations when correcting the tone correction table.

7. The image forming apparatus according to claim 6, wherein the correcting unit is further configured to select, when correcting the tone correction table, a different combination than the combination selected the previous time the tone correction table was corrected.

8. The image forming apparatus according to claim 1, further comprising:

a transfer unit configured to transfer the image formed on the image carrier by the forming unit onto a recording material;

a fixing unit configured to fix, on the recording material, the image that has been transferred onto the recording material;

a reading unit configured to read the image fixed on the recording material; and a generating unit configured to generate the reference table by causing the reading unit to read the plurality of images in the second test pattern fixed on the recording material.

9. The image forming apparatus according to claim 1, wherein the correcting unit is further configured to interpolate the updated tone correction table by obtaining an output image data value corresponding to an input value between two adjacent input image data values among the plurality of input image data values used to form the first test pattern, based on the output image data values in the updated tone correction table corresponding to the two input image data values, the output image data values in the reference table corresponding to the two input image data values, and the output image data value in the reference table corresponding to the input value.

* * * * *